US006584620B1

(12) United States Patent
Reutov et al.

(10) Patent No.: US 6,584,620 B1
(45) Date of Patent: Jul. 1, 2003

(54) DETACHABLE TOILET VENTILATION SYSTEM

(76) Inventors: Aleksey Reutov, 2505 Longview Dr., Fairfield, CA (US) 94533; Andrey Balun, 22943 SE. 43rd Pl., Sammamish, WA (US) 98075

( * ) Notice: Subject to any disclaimer, the term of this patent is extended or adjusted under 35 U.S.C. 154(b) by 0 days.

(21) Appl. No.: 10/280,227

(22) Filed: Oct. 25, 2002

(51) Int. Cl.[7] ..... E03D 9/04
(52) U.S. Cl. ..... 4/213; 4/216
(58) Field of Search ..... 4/306, 347, 348, 4/209 R, 211, 213, 216, 218

(56) References Cited

U.S. PATENT DOCUMENTS 4,853,981 A * 8/1989 Hunnicutt, Jr. ..... 4/213
4,882,790 A * 11/1989 Ricard ..... 4/213
5,170,512 A * 12/1992 Prisco ..... 4/213
5,179,737 A * 1/1993 Ricard ..... 4/213
5,745,927 A * 5/1998 Hoareau ..... 4/213

* cited by examiner

*Primary Examiner*—Tuan N. Nguyen
(74) *Attorney, Agent, or Firm*—David L. Tingey

(57) ABSTRACT

An exhaust head mounted detachably to a toilet side includes a collection portion that extends inward toward the toilet bowl between the toilet base and toilet seat to collect toilet gases. The head conforms to the shape of the toilet base with a thin profile as it proceeds rearward along the toilet base from the collection portion. An inconspicuous lavatory outlet duct runs along the lavatory wall and ceiling to provide fluid communication between flexible tube and the lavatory vent. A flexible tube that bends to allow the head to be removed from the toilet for cleaning connects the head to the outlet duct. Typically, the head is attached by means of a mild magnet attached with adhesive to the toilet base side and a matching ferromagnetic material on the head aligned with the magnet. A vent insert, to which the lavatory vents are connected, is provided for installation between a preexisting room vent cover and a building duct for closing the vent upon command. To close the insert slots, a battery-operated solenoid shifts a slotted cover plate between an open position and a closed position in which the insert covers the plate slots.

8 Claims, 5 Drawing Sheets

DETACHABLE TOILET VENTILATION SYSTEM

BACKGROUND

1. Field of the Invention

This invention related to ventilation of toilets, and specifically to ventilation devices detachably mounted to existing toilet facilities.

2. Prior Art

Many and varied devices have been disclosed for removing gases with unpleasant odors from a lavatory (toilet closet). Their common approach is to gather the gases from the toilet bowl before the gases escape into the lavatory.

Several devices employ a toilet seat with passageways leading from under the seat where it might collect gases to a hollow toilet seat hinge through which the gases are routed. A duct is then connected to the seat hinge and air is thus vented out of the lavatory. The duct can be unsightly and though functional, not welcome within a well-kept and decorated bathroom. Others employ a device that sits between the toilet seat and the toilet base that collects gases from the toilet bowl and routes it again to a hollow hinge and out a duct. Some also employ filters near the toilet. All of these prior devices require replacement of toilet hardware such as the toilet seat and cover and the hinge through which the seat and cover mount to the toilet base. This generally is an impediment to implementation and more so in temporary living quarters such as apartments where such devices would have to be removed and original hardware replaced when the tenants relocate, assuming the original hardware would be still available then. Prior toilet ventilation devices also are implemented integral with the toilet seat and/or hinge making them difficult if not impractical to clean, which is wholly unacceptable.

The primary object of this invention is to provide a simple and inexpensive device mounted inconspicuously on an existing toilet without removing or replacing any toilet hardware such as the seat, cover, hinges, base or tank. Another object is that the device be detachably mounted, lending itself to facile removal for cleaning. A further object is to provide a device that exploits an existing toilet room ventilation fan and duct.

SUMMARY

These objects are achieved in an exhaust head mounted detachably to a toilet side with a collection portion extending inward toward the toilet bowl between the toilet base and toilet seat. The collection portion is necessarily thin to fit between the toilet base and the toilet seat and wide to enable sufficient volume, limited in width by the location of seat supports under the seat that space the seat apart from the base; the collection portion is intended to fit between seat supports or between a seat support and the seat hinge.

Typically, the head is attached by means of a mild magnet attached with adhesive to the toilet base side and a matching ferromagnetic material on the head aligned with the magnet. The head is easily removed for cleaning simply by gently pulling the head away from the toilet base. Clearly, there are a number of ways that the head can be attached to the toilet base. The mild magnet is illustrative of one of those ways but other ways are deemed to be included in the scope of this invention.

So the head is largely inconspicuous the head conforms to the shape of the toilet base rim as it proceeds rearward along the toilet base from the collection portion with a thin profile until it ends at a rearward opening with a through passageway between the collection portion and the rearward opening. A flexible tube connects to the rearward portion, bending to allow the head to be removed from the toilet for cleaning.

A lavatory outlet duct shaped to inconspicuously runs along the lavatory wall and ceiling provide fluid communication between flexible tube and the lavatory vent. The duct cross section maybe triangular to fit along a corner or flat and thin to run along a wall and ceiling. A fan operating within the room vent draws gas from the head collection portion and out the room vent.

To enhance the draw, the room vent is closed during operation of the toilet facilities. A vent insert, to which the lavatory vents are connected, installed between the existing vent cover and the vent duct closes the vent. The insert has a first plurality of slots that provide airflow in cooperation with the room vent cover. To close the insert slots, the insert includes a battery-operated solenoid that shifts a slotted cover plate between an open position in which this second plurality of slots align with the first plurality of slots and a closed position in which the second plurality of slots do not align, the cover plate then covering the first plurality of slots.

DETAILED DESCRIPTION OF THE PREFERRED EMBODIMENTS

Figure 1:
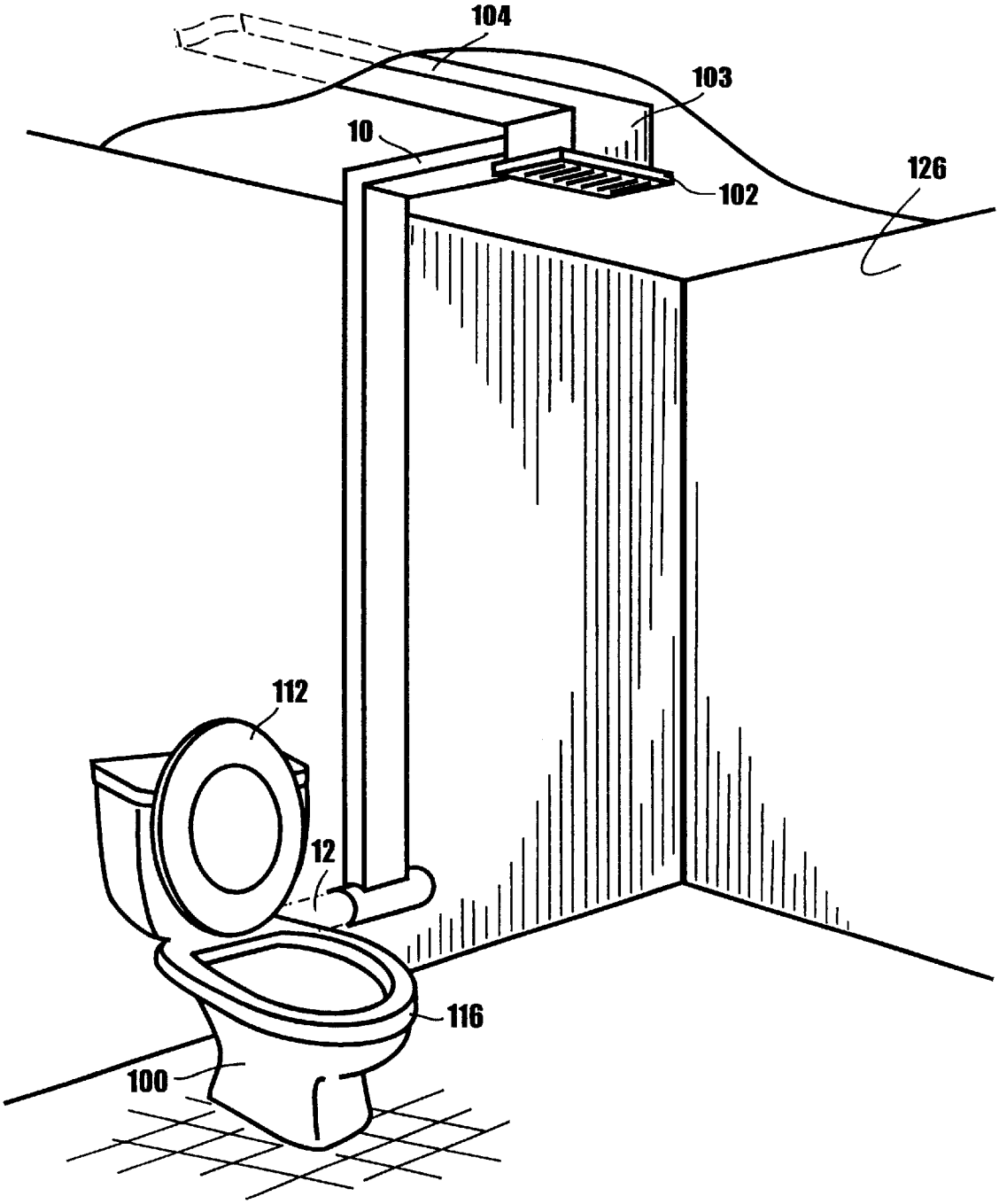
FIG. 1 is a perspective view of a venting head removably mounted on a toilet side, connected by a flexible tube to a lavatory room duct on the room wall and ceiling providing fluid communication to the room vent.
Figure 2:
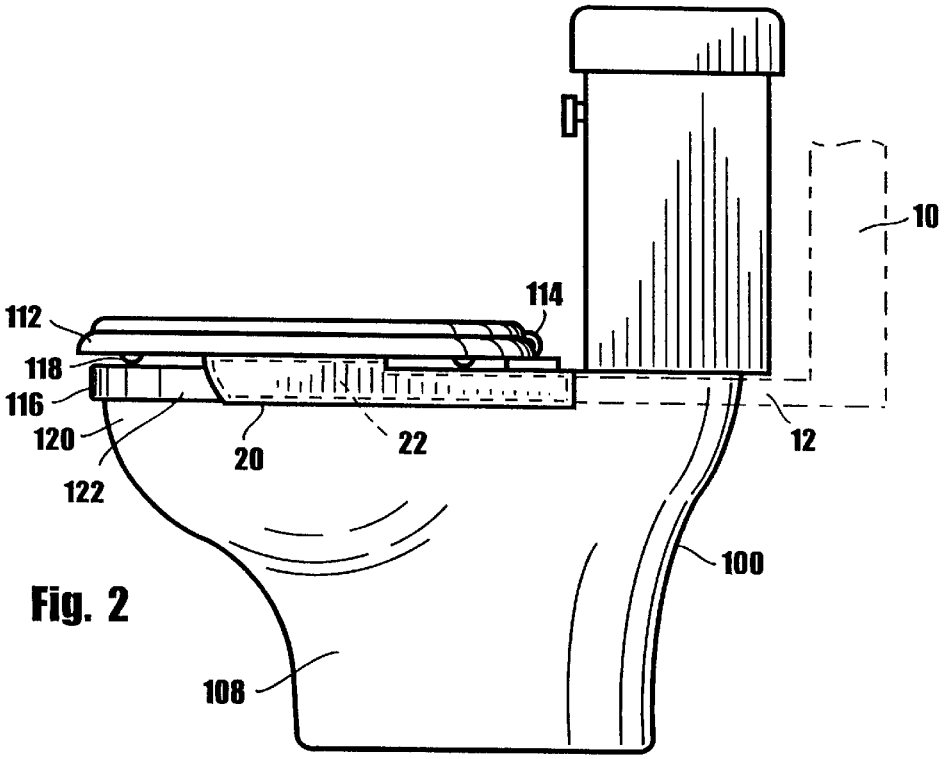
FIG. 2 is a side view of the venting head mounted to a toilet side.
Figure 4:
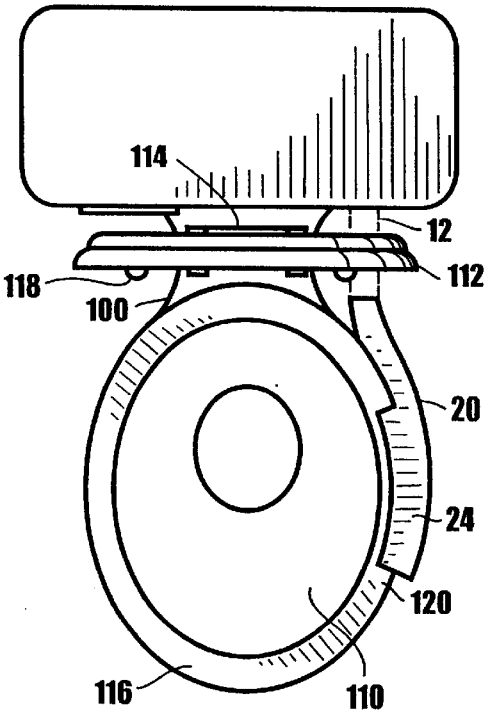
FIG. 4 is a top view of the venting head of FIG. 2.
Figure 3:
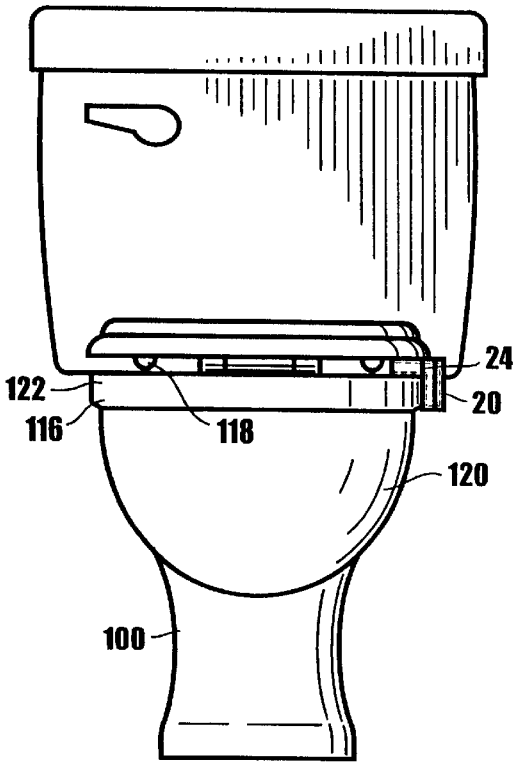
FIG. 3 is a front view of the venting head of FIG. 3 mounted to the toilet side.
Figure 5:
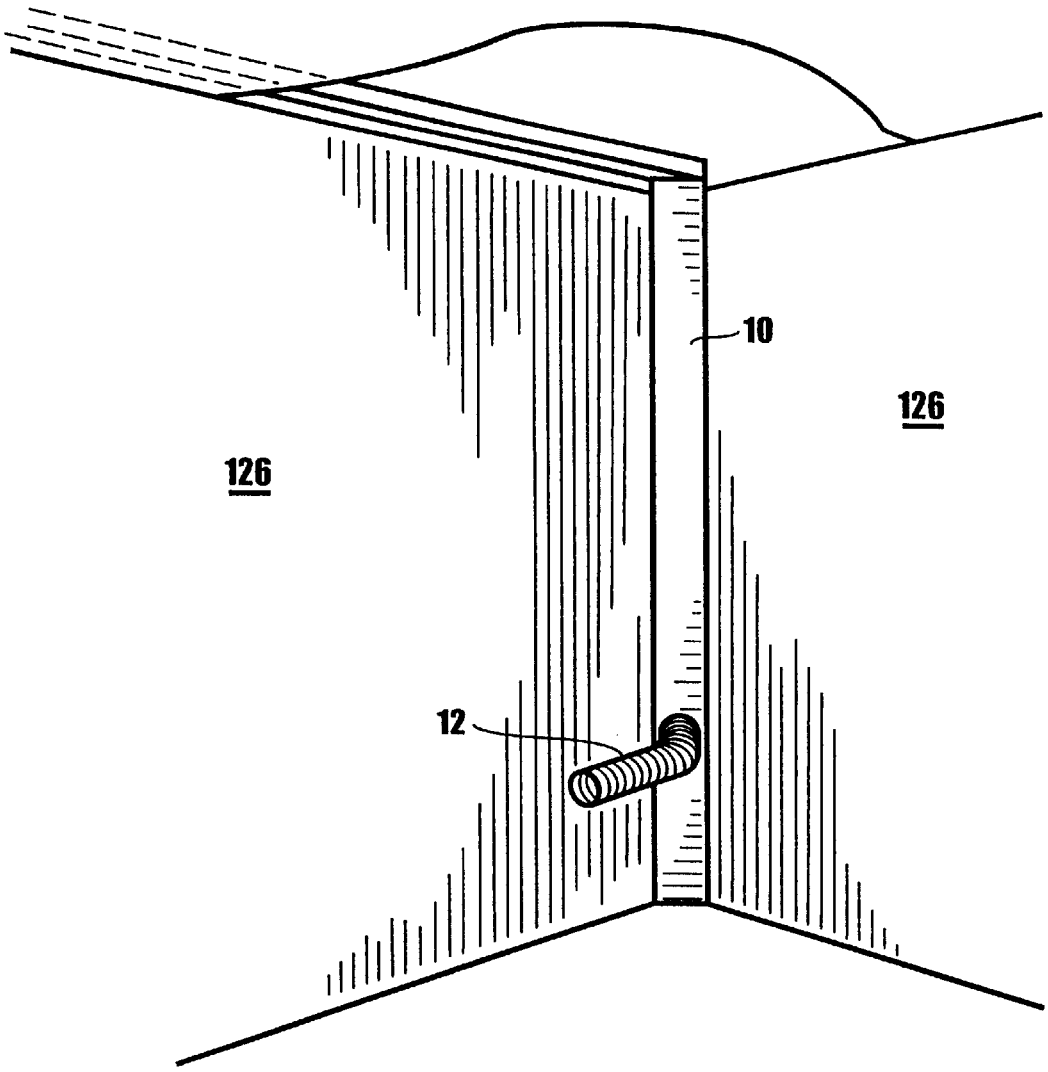
FIG. 5 is a perspective view of the room ducts running along room corners to largely conceal the ducts as decorative molding.
Figure 6:
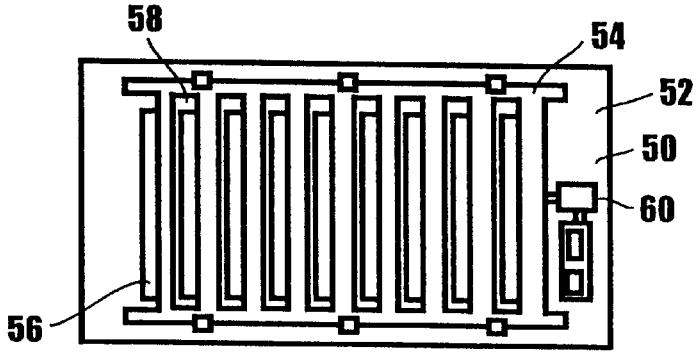
FIG. 6 is a perspective view of the upper vent insert side.
Figure 7:
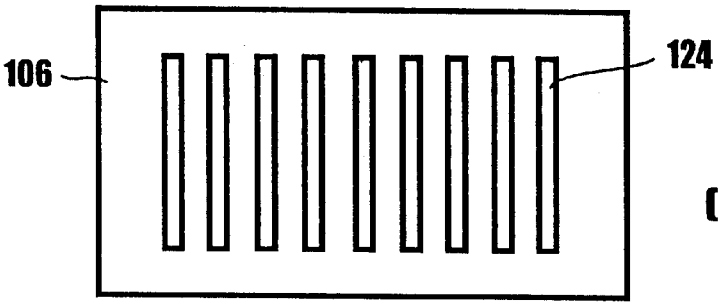
Fig. 7 (Prior Art)
FIG. 7 is a bottom view of a vent cover plate.
Figure 8:
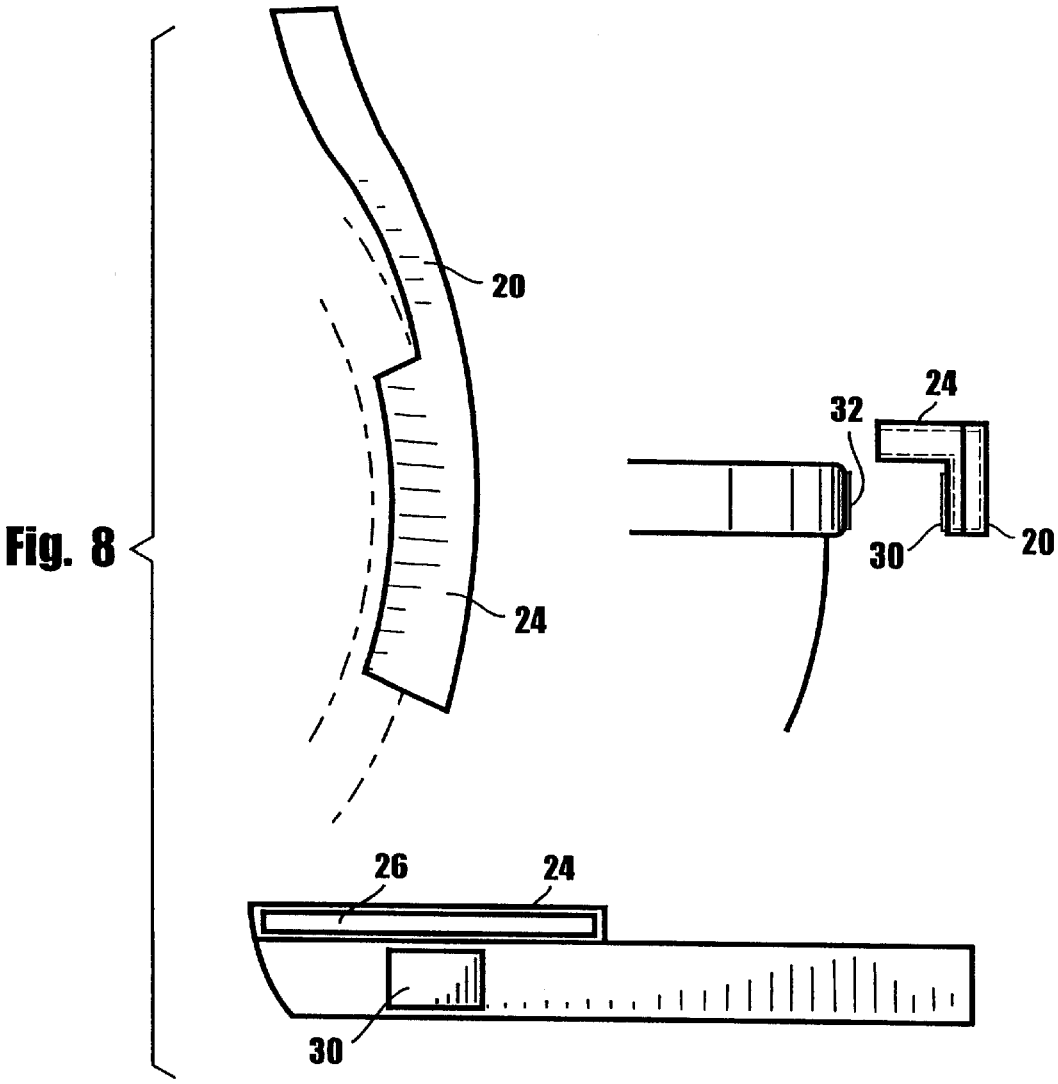
FIG. 8 are top, front and side views of the venting head, including a ferromagnetic plate on the head opposite a mild magnetic strip for adhesive attachment to the outside of the toilet bowl rim.
Figure 10:
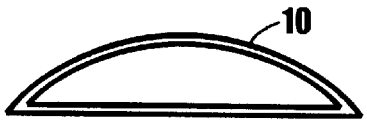
FIG. 10 is a cross section of a room duct showing an arcuate outer surface meeting a flat surface that is intended to lie against a wall or ceiling.
Figure 9:
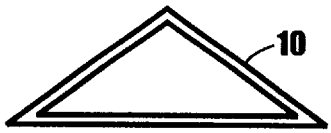
FIG. 9 is a cross section of a triangularly shaped room duct for fitting along a room corner.

The toilet venting system of the present invention vents toilet gases from the toilet 100 through an outlet duct 10 to a lavatory room vent 102 at an end 103 of a building duct 104. A slotted cover plate 106 covers the room vent 102. The system is adapted for installation on a traditional toilet 100 that has a base 108 with a bowl 110 within and a seat 112 on a seat hinge 114 spaced apart from the toilet base rim 116 around the toilet bowl 110 by seat supports 118 without removal, replacement or modification of the toilet hinge 114 or seat 112.

A vent head 20 having a passageway 22 therethrough detachably mounts on the toilet base side 120 for ease of cleaning with a head collection portion 24 resting on the toilet rim 116 with an opening 26 in the head collection portion 24 directed toward the toilet bowl 110 through which gases in the toilet bowl are collected into the head 20. The collection portion 24 necessarily has a thin profile fitting in height between the toilet seat 112 and the toilet base rim 116 and in width on the toilet base side 120 between the seat supports 118 or a seat support 118 and the hinge 114 if there are no rearward seat supports. So the vent head remains inconspicuous and aesthetically pleasing, it maintains a thin profile in a contoured shape generally matching the toilet base rim 116 along its outside 122 as the vent head 20 proceeds rearward to connection to the outlet duct 10.

The vent head 20 is secured to the toilet base side 120 typically with a ferromagnetic material 30 on the vent head 20 and a magnet 32 mounted on the toilet base 108 with an adhesive opposite the ferromagnetic material 30.

A flexible tube 12 connects between the head 20 and the outlet duct 10 accommodating detachment of the head 20 from the toilet base 108 for cleaning while maintaining fluid connection to the outlet duct 10. The outlet duct 10 provides fluid communication between the vent head 20 and a room vent insert 50 mountable between a room vent cover plate 106 and the building duct 104 to cover and uncover cover plate slots 124. The outlet duct 10 may comprise a triangular cross section suitable for mounting along a lavatory corner or a cross section having a shape of a segment of a circle suitable for mounting inconspicuously along a lavatory wall or ceiling 126. The insert 50 comprises two opposing slotted plates 52 and 54, each with a plurality of parallel slots 56 and 58, that slide between covered and uncovered positions such that when the insert is in its covered position, gas is drawn primarily from the outlet duct 10 into the building duct 104 and when the insert 50 is in its uncovered position, gas is drawn primarily through slots 124 of the cover plate 106. A battery-operated solenoid 60 actuated remotely operationally shifts the second plate 54 relative to the first plate 52, typically receiving its commands from a remote transmitter to a receiver electrically (not shown) connected to the solenoid 60.

What is claimed is:

1. A toilet ventilation system for venting toilet gases through an outlet duct from the toilet to a lavatory room vent comprising a slotted cover plate over a building duct end, the toilet including a base with a bowl within and a seat on a seat hinge and spaced apart from a toilet base rim around the toilet bowl by seat supports, the improvement comprising, a vent head having a passageway therethrough detachably mounted on the toilet base side for ease of cleaning with a head collection portion adapted to rest on the toilet rim with an opening directed toward the toilet bowl through which gases in the toilet bowl are collected into the head, the collection portion having a thin profile fitting in height between the toilet seat and the toilet base rim and in width on the toilet base side between the seat supports or a seat support and the hinge, an outlet duct providing fluid communication between the vent head and the lavatory room vent, wherein the vent head and outlet duct are detachably mounted to the toilet base without removal, replacement or modification of the toilet hinge or seat, a room vent insert to which the outlet duct is connected, mountable between the room vent cover plate and the building duct, adapted to cover and uncover cover plate slots such that when the insert is in its covered position, gas is drawn primarily from the outlet duct into the building duct and when the insert is in its uncovered position, gas is drawn primarily through slots of the cover plate, wherein the vent insert comprises a first plate having a first plurality of slots that provide airflow in cooperation with the room vent cover, a second plate opposite the first plate and having a second plurality of slots, the second plate shifting between an open position in which this second plurality of slots align with the first plurality of slots of the first plate and a closed position in which the second plurality of slots do not align, the cover plate then covering the first plurality of slots effectively stopping air flow through the room vent cover, and wherein the vent insert comprises a battery-operated solenoid actuated remotely that operationally shifts the second plate relative to the first plate.

2. The toilet ventilation system of claim 1 wherein the vent head comprises a contoured shape generally matching the toilet base rim along its outside proceeding rearward to connection to the outlet duct.

3. The toilet ventilation system of claim 2 wherein the vent head maintains a thin profile for inconspicuous mounting on the toilet base.

4. The toilet ventilation system of claim 1 further comprising a ferromagnetic material on the vent head, a magnet for adhering on the toilet base, opposite the ferromagnetic material, arranged to detachably securing the head to the toilet base with the head collection portion on the toilet rim.

5. The toilet ventilation system of claim 1 further comprising a flexible tube between the head and the outlet duct, adapted to accommodate detachment of the head from the toilet base for cleaning while maintaining fluid connection to the outlet duct.

6. The toilet ventilation system of claim 1 wherein said outlet duct further comprises a triangular cross section suitable for mounting along a lavatory corner.

7. The toilet ventilation system of claim 1 wherein said outlet duct further comprises a cross section having a shape of a segment of a circle suitable for mounting inconspicuously along a lavatory wall or ceiling.

8. A toilet ventilation system for venting toilet gases through an outlet duct from the toilet to a lavatory room vent comprising a slotted cover plate over a building duct end, the toilet including a base with a bowl within and a seat on a seat hinge and spaced apart from a toilet base rim around the toilet bowl by seat supports, the improvement comprising, a vent head having a passageway therethrough detachably mounted on the toilet base side for ease of cleaning with a head collection portion adapted to rest on the toilet rim with an opening directed toward the toilet bowl through which gases in the toilet bowl are collected into the head, the collection portion having a thin profile fitting in height between the toilet seat and the toilet base rim and in width on the toilet base side between the seat supports or a seat support and the hinge, an outlet duct providing fluid communication between the vent head and the lavatory room vent, wherein the vent head and outlet duct are detachably mounted to the toilet base without removal, replacement or modification of the toilet hinge or seat, and wherein the vent head comprises a contoured shape generally matching the toilet base rim along its outside proceeding rearward to connection to the outlet duct and a thin profile for inconspicuous mounting on the toilet base, a room vent insert to which the outlet duct is connected, mountable between the room vent cover plate and the building duct, adapted to cover and uncover cover plate slots such that when the insert is in its covered position, gas is drawn primarily from the outlet duct into the building duct and when the insert is in its uncovered position, gas is drawn primarily through slots of the cover plate, the vent insert comprising a first plate having a first plurality of slots that provide airflow in cooperation with the room vent cover and a second plate opposite the first plate and having a second plurality of slots, the second plate shifting between an open position in which this second plurality of slots align with the first plurality of slots of the first plate and a closed position in which the second plurality of slots do not align, the cover plate then covering the first plurality of slots effectively stopping air flow through the room vent cover, wherein the vent insert comprises a battery-operated solenoid actuated remotely that operationally shifts the second plate relative to the first plate, a ferromagnetic material on the vent head, a magnet for adhering on the toilet base, opposite the ferromagnetic material, arranged to detachably securing the head to the toilet base with the head collection portion on the toilet rim, a flexible tube between the head and the outlet duct, adapted to accommodate detachment of the head from the toilet base for cleaning while maintaining fluid connection to the outlet duct.

* * * * *